US007479092B2

(12) United States Patent
Alessandri et al.

(10) Patent No.: US 7,479,092 B2
(45) Date of Patent: Jan. 20, 2009

(54) EXERCISE MACHINE

(75) Inventors: Nerio Alessandri, Longiano (IT); Roberto Zini, Lugo (IT)

(73) Assignee: Technogym S.p.A., Forli Cesena (IT)

( * ) Notice: Subject to any disclaimer, the term of this patent is extended or adjusted under 35 U.S.C. 154(b) by 1034 days.

(21) Appl. No.: 10/655,000

(22) Filed: Sep. 5, 2003

(65) Prior Publication Data

US 2004/0072652 A1 Apr. 15, 2004

(30) Foreign Application Priority Data

Sep. 10, 2002 (IT) ..... BO2002A0574

(51) Int. Cl.
*A63B 21/00* (2006.01)

(52) U.S. Cl. ..... 482/8; 482/4; 482/9; 482/901

(58) Field of Classification Search ..... 482/1–9, 482/900–902, 51, 54; 434/247; 705/400; 600/300

See application file for complete search history.

(56) References Cited

U.S. PATENT DOCUMENTS 6,921,351 B1 * 7/2005 Hickman et al. ..... 482/8
2002/0039952 A1 4/2002 Clem
2002/0147693 A1 * 10/2002 Banerjee et al. ..... 705/400

FOREIGN PATENT DOCUMENTS

| | | |
|---|---|---|
| EP | 1 068 882 A2 | 7/2000 |
| WO | WO 97/05727 | 2/1997 |
| WO | WO 02/062425 A2 | 8/2002 |

* cited by examiner

*Primary Examiner*—Glenn Richman
(74) *Attorney, Agent, or Firm*—Arent Fox LLP

(57) ABSTRACT

An exercise machine (1) comprises means (10) for performing an exercise, allowing a user to perform at least one predetermined gymnastic exercise, and adjusting means (20), for adjusting the operation of the means (10) for performing an exercise. The exercise machine (1) also has a predetermined number of sensors (30), for detecting at least one exercise machine (1) operating parameter (100). A processing unit (40) receives the operating parameter (100) and generates one or more web pages (110) incorporating the operating parameter (100). Connecting means (60) create a permanent connection between the Internet network (150) and the processing unit (40). A receiver-transmitter block (50) receives a request signal (120) from a remote processor (70) by means of the permanent connection, and transmits a transmission signal (130) incorporating one or more web pages (110) to the remote processor (70).

9 Claims, 1 Drawing Sheet

EXERCISE MACHINE

BACKGROUND OF THE INVENTION

The present invention relates to an exercise machine, in particular set up for connection to the Internet network.

As is known, there are various types of exercise machines, used in gyms by users wanting to improve or maintain their physical fitness by exercising the various muscles in their bodies.

Such exercise machines may be used both for cardiovascular type training (for example, treadmills, bikes, recliners, steppers, elliptical cross-trainers, etc.), and for training intended to improve the athlete's strength (for example, shoulder presses, chest presses, etc.).

At present, each of these exercise machines can be connected to the Internet network, so that a remote trainer, that is to say, a trainer not able to be close to the machine and speak directly to the user at that moment, can still be kept informed about machine operation and the athlete's performance, and can also interact with the machine, setting its characteristic parameters and operating values, according to the capacity and condition of the user.

Exercise machines in prior art, therefore, have a predetermined number of sensors, each designed to detect a machine operating parameter, preferably relative to the exercise performed by the user, and a processing unit, designed to gather the information from the sensors and transmit it to the remote trainer.

For this purpose, the above-mentioned processing unit, basically made like a conventional PC, has a connection software, which allows connection to the Internet network and data transmission to the trainer. As indicated above, according to the information received, if necessary, the trainer changes the machine settings, so that the training is tailored to the requirements and athletic condition of the user.

A first operating limit relative to the systems described above is the fact that Internet connections between the exercise machine and the remote trainer required the exercise machine to always connect as the "client", necessitating minimum software-hardware requirements at least equal to those of a conventional PC. In particular, the processor associated with the exercise machine must have at least one Internet browser, including all the applications necessary to detect and interpret text, images, sounds regularly encountered when browsing on the Internet network.

This has quite a negative effect on the production costs and overall dimensions of each exercise machine.

In addition to the above, in order to activate the Internet connection with the trainer each time the athlete must perform his or her exercises and requires supervision by his or her trainer, a keyboard, mouse and display are generally essential, further increasing the space occupied by the machine, during both transportation and use.

SUMMARY OF THE INVENTION

The aim of the present invention is, therefore, to overcome the above-mentioned disadvantages.

In particular, the aim of the present invention is to provide an exercise machine able to send and receive data and information over the Internet network using minimum hardware-software resources, characterized by limited structural complexity and reduced set up costs.

Another aim of the present invention is to provide an exercise machine which can be connected to the Internet network and which has limited dimensions and contained production costs.

These and other aims are substantially achieved by an exercise machine made as described in the claims herein.

BRIEF DESCRIPTION OF THE DRAWINGS

Further features and advantages of the present invention are apparent in the detailed description below, with reference to a preferred embodiment illustrated in the accompanying drawing, which shows a block diagram of an exercise machine made according to the present invention and without limiting the scope of its application.

DESCRIPTION OF THE PREFERRED EMBODIMENTS

Figure 1:
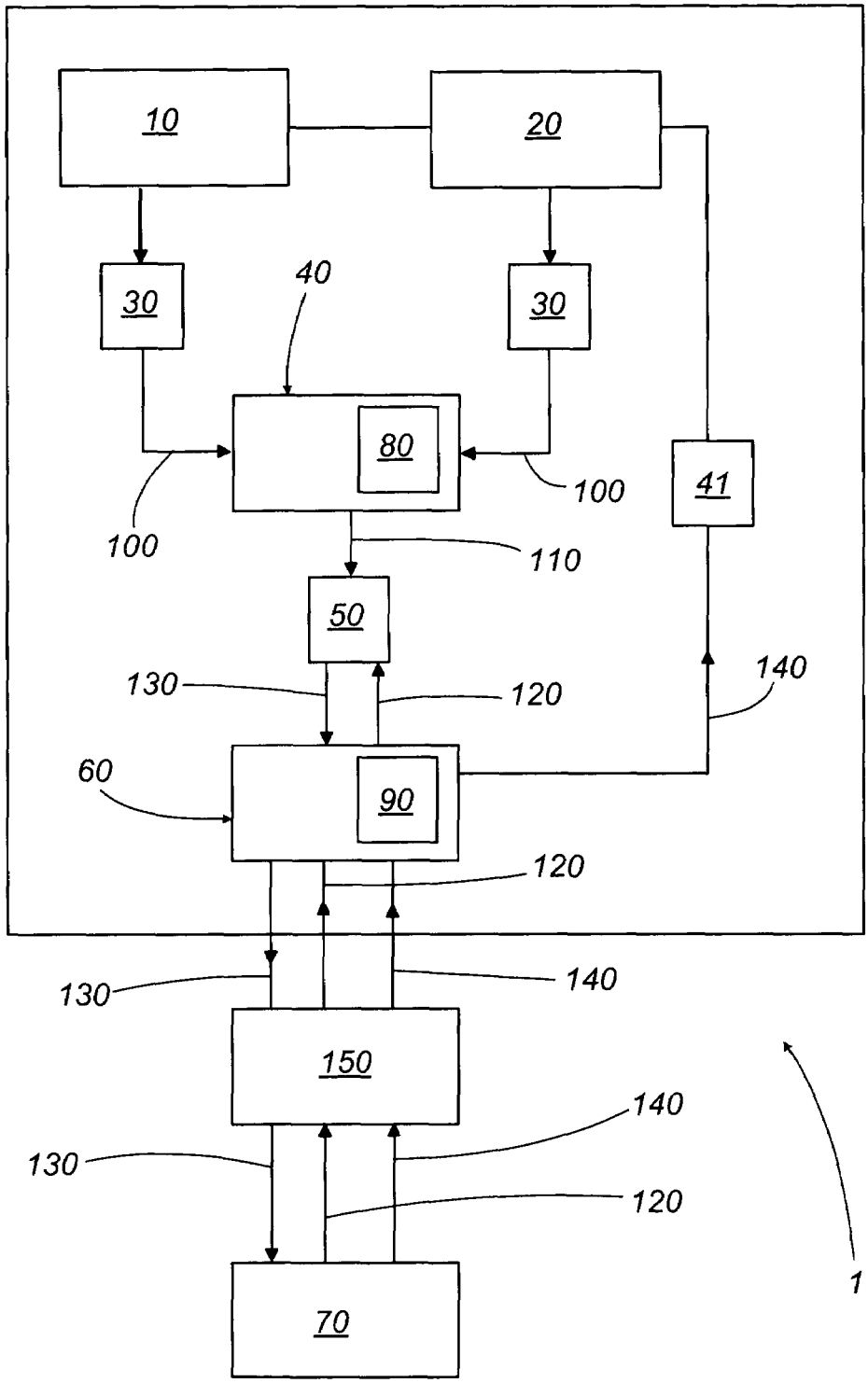

The exercise machine disclosed is labeled 1 as a whole.

The exercise machine 1 comprises firstly means 10 for performing an exercise, allowing a user to perform at least one predetermined gymnastic exercise.

The means 10 for performing an exercise may consist, for example, of the rotary belt of a treadmill, the pedals of an exercise bike or elliptical cross-trainer, the weights and grip means connected to them in machines such as the shoulder press, chest press, etc.

The means 10 for performing an exercise are fitted with adjusting means 20, operating on the means 10 for performing an exercise to adjust their operation.

The adjusting means 20 basically consist of the mechanical, electronic and/or electromechanical devices used to set the operation of the means 10 for performing an exercise and, as a result, modulate the effort made by the athlete.

For example, the apparatus needed to set and vary the speed of the rotary belt on a treadmill, the resistance offered by the pedals of an exercise bike, the load to be used in machines such as a shoulder press or chest press, etc.

The exercise machine 1 also has a predetermined number of sensors 30, each connected to the means 10 for performing an exercise and/or to the adjusting means 20 and designed to detect at least one exercise machine 1 operating parameter 100.

In the case of an exercise machine for user strength training (shoulder press, chest press, etc.), the operating parameters 100 may include, for example, the weight of the load to be moved by the athlete, the number of sets of repetitions completed with each of the loads selected, etc.

In the case of a treadmill, the operating parameters 100 may comprise the rotary belt sliding speed, the distance traveled by the belt (obtained by integrating the speed detected), etc.

In the case of an exercise bike, the operating parameters 100 may comprise the speed of movement of the pedals, it normally being possible to move the pedals with alternating to and fro motion, allowing the user to simulate the movement typical of pedaling a conventional bicycle. The operating parameters 100 of an exercise bike may also comprise the "distance" traveled by the athlete using the pedals, that is to say, the distance that the athlete would have covered if he or she performed the exercise on a conventional bicycle.

Moreover, generally speaking, the operating parameters 100 may include the total or partial time for which the exercise machine 1 was used, together with the types of exercises performed by the user with the means 10 for performing an exercise.

The operating parameters 100 detected by the sensors 30 are received by a processing unit 40, preferably incorporated in the exercise machine 1. The processing unit 40 is designed to generate one or more web pages 110, incorporating the above-mentioned operating parameters 100.

Depending on requirements, the web pages 110 may consist of a simple list of the values detected, or may have suitable graphics, designed to reproduce, for example, the control display on the exercise machine 1.

The exercise machine 1 is set up for connection to the Internet network 150, so that the web pages 110 can be made available to a remote trainer, allowing the latter to set and monitor the training done by the exercise machine 1 user.

For this purpose, the exercise machine 1 is equipped with a receiver and transmitter block 50, able to receive a request signal 120, from a remote processor 70, and, following said reception, able to transmit a transmission signal 130, intended for the above-mentioned remote processor 70 and incorporating one or more of the web pages 110 generated by the processing unit 40.

In practice, the trainer uses the remote processor 70 to connect to the exercise machine 1 via the Internet network 150, sending a suitable request signal 120, to retrieve all information necessary to evaluate the athlete's activities.

Upon receiving the request signal 120, the receiver/transmitter block 50 sends the remote processor 70 the transmission signal 130, which contains the various web pages 110 incorporating the data relative to the exercise machine 1 and, in particular, to the means 10 for performing an exercise and to the adjusting means 20.

As indicated above, the connection between the exercise machine 1 and the remote processor 70 is achieved using the Internet network 150. Therefore, the exercise machine 1 has suitable connecting means 60, inserted between the Internet network 150 and the processing unit 40, creating a permanent connection between the Internet network 150 and the processing unit 40. The connection between the exercise machine 1 and the Internet network 150 may be made, for example, by means of a telephone dial-up using a modem.

The request signal 120 is received and the transmission signal 130 sent by means of the above-mentioned permanent connection.

In other words, the electronic circuits connected to the exercise machine 1 and consisting of the processing unit 40, the receiver/transmitter block 50 and the connecting means 60, allow the creation of a micro-Internet site specifically dedicated to the exercise machine 1.

A fundamental feature of an Internet site is that it is practically always connected to the network, so that it is continuously available to all of those who want to access the site content. Therefore, in this context, "permanent connection" means a connection to the Internet network which is normally ON, characterizing Internet sites and differentiating them from conventional "clients", which, in contrast, must establish a new connection each time they need to exchange data with a remote processor.

Obviously, for faults, maintenance, or other extremely practical reasons, the connection between the exercise machine 1 (and in particular the processing unit 40 and the receiver/transmitter block 50) and the Internet network may be interrupted, without thereby altering the substantial temporal continuity of the connection.

Advantageously, the connecting means 60 comprise an auxiliary memory 90, set up to hold a permanent IP address, unambiguously associated with the exercise machine 1. This IP address is used to define the above-mentioned permanent connection to the Internet network 150.

Another basic features of an Internet site is the fact that the server which physically incorporates the site content is identified by means of an IP (Internet Protocol) address, so that the server can be correctly addressed by the various routers and providers forming the Internet network 150.

The IP address consists of a 32-bit number, for the sake of convenience normally represented as a sequence of four numbers, each between 0 and 255, and separated from the others by a point (for example, 192.168.9.112).

As indicated above, the IP addresses are used to identify the physical machines in which the web pages are contained, together with the content linked to them, forming an Internet site.

To allow network users to remember the addresses of the various sites, each IP address is unambiguously associated with a domain name, that is to say, a kind of name or title, assigned to the site, and indicating the type of site content (e.g.: "www.technogym.com").

When a network user decides to connect to a predetermined Internet site, he or she types the name to the site to be visited in the browser address bar. In the case in question, the trainer types the domain name associated with the machine he or she wants to connect to (for example, without in any way limiting the scope of the invention "www.technogymmachine1.com").

Basically, typing this domain name generates the request signal 120. The domain name is immediately converted into the corresponding IP address, so that the request is correctly "routed" to the exercise machine 1.

This is made possible by the structure of the Internet network, within which the various "nodes" can, thanks to a set of presaved tables, appropriately send signals to the selected recipient.

A first table allows retrieval of the recipient's IP address, if the domain name associated with it is known. The subsequent tables allow the distance which physically separates the remote processor 70 from the exercise machine 1 to be covered by suitably selecting the branches of the network to be used for the transmission.

Finally, a last database associates to the IP address a branch directly connected to the recipient computer, so that the information can be delivered to it.

In light of the above, it is evident how the unambiguous association of a permanent IP address to the exercise machine 1 allows the machine to be presented to Internet network users, and in particular to the remote trainer, as a proper site, which the trainer can access irrespective of the physical distance separating the exercise machine and the trainer's remote processor 70.

In some cases, for example when the various servers and providers reorganize their internal databases, in order to optimize the use of hardware-software resources and make network operation as efficient as possible, the IP addresses associated with each site may vary. However, this does not mean that the IP address associated with a predetermined Internet site cannot be called "permanent", as opposed to the temporary code assigned to normal "clients" each time they access the network through their provider.

Therefore, the permanent IP address assigned to the exercise machine 1 is first saved in the registers of machines which make up the network, as indicated above, and preferably also held in the auxiliary memory 90.

Conveniently, the processing unit 40 may also have a main memory 80, set up to hold the above-mentioned web pages 110, generated according to the operating parameters 100 detected by the sensors 30.

In this way, the exercise machine 1 can supply the remote trainer, associated with the remote processor 70, not just "real time" information, but also data saved at a previous point in time.

It is important to emphasize how detecting and saving machine 1 operating parameters 100 may also be extremely useful for maintenance of the exercise machine 1. Values such as, for example, the total time for which the machine has been used, or the total distance covered using the means 10 for performing an exercise, may be used to identify the moments when a control and/or periodic maintenance must be carried out.

In the preferred embodiment, the processing unit 40, the receiver-transmitter block 50, and the connecting means 60, together with the memories 80, 90, consist of a microchip, incorporated in the machine 1 and designed to perform the above-mentioned functions. Basically, the microchip is a miniature server, physically located inside the machine 1 structure, and able to create the micro-site specifically dedicated to the exercise machine 1.

Another function provided by the exercise machine 1 is the possibility of having its operation set up and adjusted by signals arriving from the remote processor 70, so as to allow the remote trainer to actively operate on the exercises which the athlete performs.

The exercise machine 1 also comprises an auxiliary processing unit 41, inserted between the connecting means 60 and the adjusting means 20 and designed to receive a command signal 140 from the remote processor 70. Depending on this command signal 140, the auxiliary processing unit 41 acts upon the adjusting means 20, adjusting operation of the means 10 for performing an exercise and modulating the effort made by the user, as dictated by the trainer.

The telecommunications protocol used for the exchange of the above-mentioned request signals 120, transmission signals 130 and command signals 140 is preferably the TCP/IP (Transmission Control Protocol/Internet Protocol) protocol.

From the point of view of exercise machine 1 operation and, in particular, the exchange of signals involving the exercise machine 1, it is important to notice the following.

Firstly, the sensors 30 detect a predetermined number of operating parameters 100, preferably relative to the means 10 for performing an exercise and/or the adjusting means 20 connected to them.

A predetermined number of web pages 110 is then generated, incorporating the operating parameters detected. As indicated above, the web pages 110 may conveniently have a suitable graphic layout, representing for example the exercise machine 1 display at the moment when it is used.

For data and information reception and transmission, a permanent connection is established between the exercise machine 1 and the Internet network 150. More specifically, in order to create an Internet site specifically dedicated to the exercise machine 1, the exercise machine 1 is assigned a permanent IP code.

Through the above-mentioned permanent connection to the Internet network 150, the exercise machine 1 receives a request signal 120, from a remote processor 70.

In practice, the request signal 120 is generated by the remote processor 70 at the moment when the domain name (or IP address) unambiguously associated with the exercise machine 1 is entered in any Internet browser.

After receiving the request signal 120, the machine sends the remote processor 70, again using the permanent connection, a transmission signal 130, incorporating the web pages 110 containing the data relative to exercise machine 1 operation.

The web pages 110 may be saved in the main memory 80, to make available to the trainer not just "real time" information, but also data relative to previous use of the exercise machine 1.

Once the information requested has been received, the remote trainer can directly adjust exercise machine 1 operation. The trainer can use the remote processor 70 to send a command signal 140 for the exercise machine 1, to change some of its characteristic operating values and tailor the training to the capacity and condition of the athlete.

The command signal 140 is received by the exercise machine 1 and, in particular, by the auxiliary processing unit 41, which acts on the adjusting means 20 according to the indications incorporated in the command signal 140.

As indicated, the telecommunications protocol used for the exchange of the request signals 120, transmission signals 130 and command signals 140 is preferably the TCP/IP (Transmission Control Protocol/Internet Protocol) protocol.

The invention has important advantages.

Firstly, for communication with the remote trainer, the exercise machine disclosed requires minimum hardware-software resources, thus limiting machine production costs and dimensions. In particular, the processor connected to the exercise machine does not require installation of the various software components normally used for Internet navigation by clients.

Moreover, for the exchange of data and information, the exercise machine disclosed uses standard, widely used telecommunications protocols. This means that the machine can communicate with any remote "client" and, in particular, with any trainer equipped with at least one of the most common browsers.

In addition to the above, thanks to the fact that the type of connection to the Internet network is completely standard, the costs for machine production and installation of the software it uses are greatly reduced.

What is claimed is:

1. An exercise machine comprising:

means for performing an exercise, allowing a user to perform at least one predetermined gymnastic exercise;

adjusting means connected to the means for performing an exercise and acting on the latter to adjust their operation;

a predetermined number of sensors, each connected to the means for performing an exercise and/or to the adjusting means and designed to detect at least one exercise machine operating parameter;

a processing unit, connected to the sensors for receiving at least one operating parameter, the processing unit being suitable for generating one or more web pages incorporating the operating parameter;

connecting means, inserted between an Internet network and the processing unit, creating a permanent connection between the Internet network and the processing unit;

a receiver-transmitter block, connected to the connecting means, for receiving, by means of the permanent connection, a request signal, from a remote processor, and, following a reception of said request signal by said receiver-transmitter block, for transmitting a transmission signal, for the remote processor and incorporating one or more of the web pages generated by the processing unit.

2. The exercise machine according to claim 1, wherein the processing unit comprises a main memory for storing at least the web pages.

3. The exercise machine according to claim 1, wherein the connecting means comprise an auxiliary memory, for holding a permanent IP code, unambiguously associated with the exercise machine, so as to create the permanent connection to the Internet network.

4. The exercise machine according to claim 1, wherein the operating parameters comprise a total time for which the exercise machine has been used and/or one or more types of exercises done by the user using the means for performing an exercise.

5. The exercise machine according to claim 1, wherein the means for performing an exercise comprise at least one load to be moved, the operating parameters preferably comprising a weight of the load and/or a number of sets of repetitions to be performed by the user with the load.

6. The exercise machine according to claim 1, wherein the means for performing an exercise comprise a rotary belt, the operating parameters preferably comprising a distance covered with the rotary belt and/or a rotary belt sliding speed.

7. The exercise machine according to claim 1, wherein the means for performing an exercise comprise at least two pedals, which can be moved with an alternating to and fro motion, the operating parameters preferably comprising a pedal movement speed and/or a distance covered using the pedals.

8. The exercise machine according to claim 1, further comprising an auxiliary processing unit, inserted between the connecting means and the adjusting means and acting on the adjusting means for receiving from the remote processor, through the permanent connection, a command signal, to adjust operation of the means for performing an exercise according to the command signal.

9. The exercise machine according to any one of claims 1 to 8, wherein the request signal and the command signal are received and the transmission signal is transmitted using the TCP/IP telecommunications protocol.

* * * * *